US007443112B2

(12) United States Patent
Wey et al.

(10) Patent No.: US 7,443,112 B2
(45) **Date of Patent: *Oct. 28, 2008**

(54) CURRENT BALANCING CIRCUIT FOR A MULTI-LAMP SYSTEM

(75) Inventors: Chin-Der Wey, Houlong Township, Miaoli County (TW); Yi-Chun Yeh, Sanchong (TW); Chia-Hung Sun, Kaohsiung (TW); Yueh-Pao Lee, Hukou Township, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/890,055

(22) Filed: Aug. 3, 2007

(65) Prior Publication Data

US 2007/0273303 A1 Nov. 29, 2007

Related U.S. Application Data

(62) Division of application No. 11/146,567, filed on Jun. 7, 2005, now Pat. No. 7,271,549.

(51) Int. Cl.
*H05B 37/02* (2006.01)
*H05B 37/00* (2006.01)

(52) U.S. Cl. ..... 315/291; 315/276; 315/277; 315/307; 315/312

(58) Field of Classification Search ..... 315/291, 315/276, 312
See application file for complete search history.

(56) References Cited

U.S. PATENT DOCUMENTS

| | | | | |
|---|---|---|---|---|
| 6,420,839 | B1 | 7/2002 | Chiang | 315/311 |
| 6,534,934 | B1 | 3/2003 | Lin et al. | 315/312 |
| 6,717,372 | B2 | 4/2004 | Lin et al. | 315/282 |
| 6,781,325 | B2 | 8/2004 | Lee | 315/282 |
| 7,271,549 | B2 * | 9/2007 | Wey et al. | 315/282 |
| 7,282,868 | B2 * | 10/2007 | Ushijima et al. | 315/277 |
| 7,309,964 | B2 * | 12/2007 | Wey et al. | 315/312 |
| 7,345,431 | B2 * | 3/2008 | Lee | 315/224 |
| 2002/0130628 | A1 | 9/2002 | Shin | 315/312 |
| 2003/0141829 | A1 | 7/2003 | Yu et al. | 315/276 |
| 2007/0152608 | A1 * | 7/2007 | Lee | 315/282 |

* cited by examiner

*Primary Examiner*—Trinh V Dinh
(74) *Attorney, Agent, or Firm*—Ware, Fressola, Van Der Sluys & Adolphson, LLP

(57) ABSTRACT

The present invention uses one or more transformers disposed between an inverter driver to drive a plurality of lamps. Each transformer has a first coil and a second coil magnetically coupled to each other. Each of the first and second coils has an input end and an output end. The input end of the first coil is operatively connected to the input end of the second coil for receiving an input current. Each of the first and second coils has a capacitor connected between the input and output ends. The output ends of the first and second coils are used to provide output current in two separate current paths. As such, the output end of a transformer can be separately connected to the input end of two lamps or two such transformers.

7 Claims, 8 Drawing Sheets

$$Z_C = \frac{1}{j\omega C} \quad , \quad Z_L = j\omega L$$

$$Z_{th} = Z_C // Z_L = \frac{Z_C \cdot Z_L}{Z_C + Z_L} = \frac{(L/C)}{(1/j\omega C) + (j\omega L)}$$

If $|Z_{th}| \to \infty$ then $$(1/j\omega C) + (j\omega L) = 0$$

$$\Rightarrow \omega^2 LC = 1$$

$$\Rightarrow \omega = \frac{1}{\sqrt{LC}}$$

CURRENT BALANCING CIRCUIT FOR A MULTI-LAMP SYSTEM

This application is a divisional application of and claims priority to a U.S. patent application Ser. No. 11/146,567, filed Jun. 7, 2005 now U.S. Pat. No. 7,271,549.

FIELD OF THE INVENTION

The present invention relates generally to an electronic circuit to control the current provide to a group of lamps and, in particular, to a back-lighting source.

BACKGROUND OF THE INVENTION

A display panel such as a transmissive or transflective liquid crystal display panel requires a back-lighting source for illumination. For a large display panel, a plurality of lamps are commonly used for such purposes. A back-lighting source using one or more lamps is known in the art. For example, a back-lighting driver circuit having an inverter driver can be used to drive a single lamp. As shown in FIG. 1, the inverter driver is used to convert a direct-current source $V_{DC}$ into an alternating-current source $V_S$ to drive a single lamp. In the inverter driver circuit, a master transformer and a capacitor, together with a plurality of switches are used as a DC to AC converter. In order to reduce the driver cost when the back-lighting source has two or more lamps, a current balancing circuit is used instead. FIG. 2 is an example of prior art multi-lamp drivers. As shown, a current balancing circuit disposed between the inverter driver and a two-lamp light source is used to control the current to each lamp. As shown in FIG. 2, an inductor and a plurality of capacitors are used to balance the current in the two paths to the two-lamp light source.

Other commonly used current balancing circuits are schematically shown in FIGS. 3 and 4. As shown, electrical characteristics of passive elements such as capacitors, inductors and transformers are used to balance the currents among the multiple current paths to a multi-lamp light source. In these type of current balancing circuits, if the current in one current path is higher than the current in the other current path, the currents can be balanced out by channeling the differential current through the capacitor. The major disadvantage of these types of current balancing circuits is that each circuit can be used to provide only two current paths to two lamps. In a light source having N pairs of lamps, N current balancing circuits and a large number of inverter drivers are required.

It is advantageous and desirable to provide a method and device for driving N pairs of lamps with a smaller number of current balancing circuits and inverter drivers.

SUMMARY OF THE INVENTION

The present invention uses one or more transformers disposed between an inverter driver to drive a plurality of lamps. Each transformer has a first coil and a second coil magnetically coupled to each other. Each of the first and second coils has an input end and an output end. The input end of the first coil is operatively connected to the input end of the second coil for receiving an input current. Each of the first and second coils has a capacitor connected between the input and output ends. The output ends of the first and second coils are used to provide output currents in two separate current paths. Such a transformer forms a basic circuit block of a driving circuit. Each of the basic circuit blocks has a block input to receive an input current and two block outputs to provide output currents in two separate current paths. The two block outputs can be connected to two lamps or two other basic circuit blocks.

Thus, in a one-level driving circuit for driving two lamps, one basic circuit block is needed. The block input is connected to the inverter driver to receive an input current. Each of the two block outputs is separately connected to one lamp.

In a light source having four lamps, a two-level driving circuit having three basic circuit blocks is needed. In the first level, one basic circuit block is used to receive an input current from the inverter driver for providing two output currents through the two block outputs. In the second levels, two basic circuit blocks are used to drive the lamps. Each of the two second-level basic circuit blocks receives an input current from a different one of the two block outputs of the first-level basic circuit block.

In the same manner, a three-level driving circuit having seven basic circuit blocks can be used to drive eight lamps: one block in the first level, two blocks in the second level, and four in the third level.

DETAILED DESCRIPTION OF THE INVENTION

Figure 1:
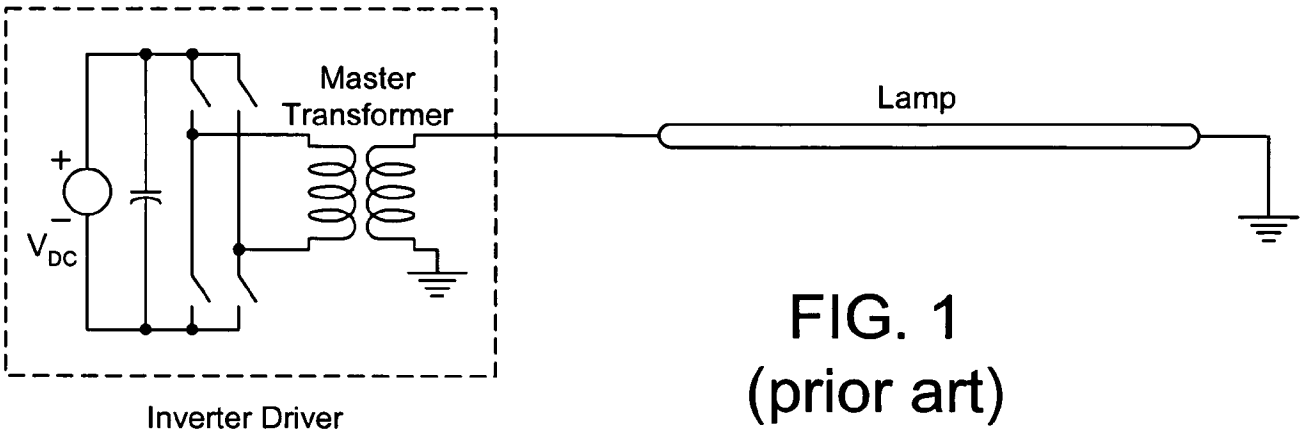
FIG. 1 (prior art)
FIG. 1 is a schematic representation of a prior art driver for driving a light source having a single lamp.
Figure 2:
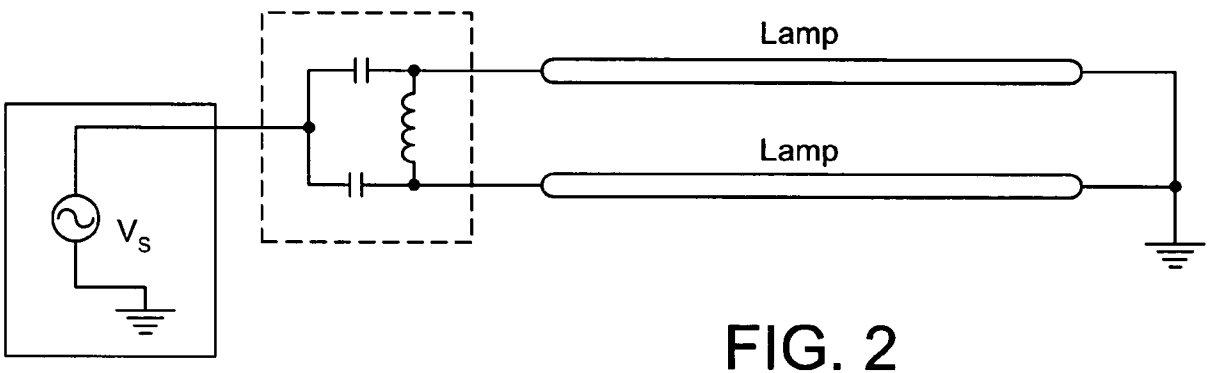
FIG. 2 (prior art)
FIG. 2 is a schematic representation of a prior art driver for driving a light source having two lamps.
Figure 3:
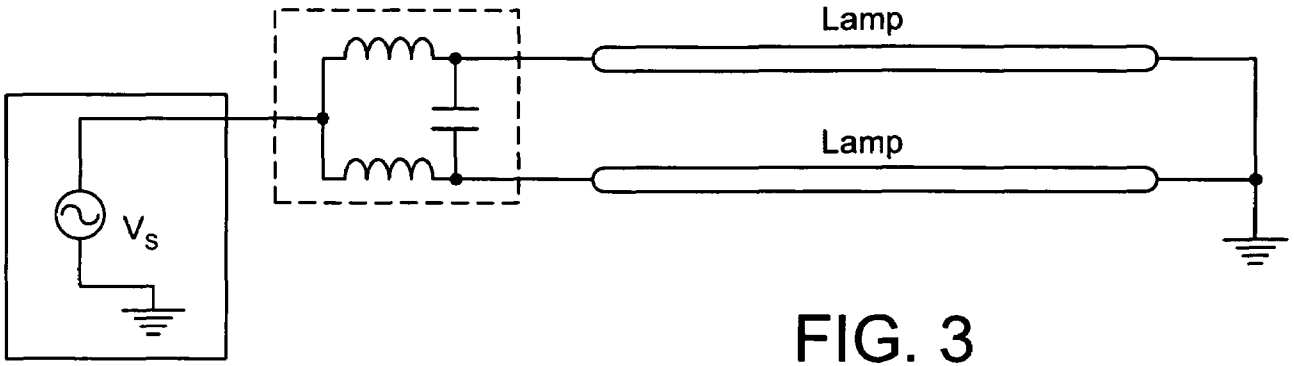
FIG. 3 (prior art)
FIG. 3 is a prior art current balancing circuit having two inductors and one capacitor.
Figure 4:
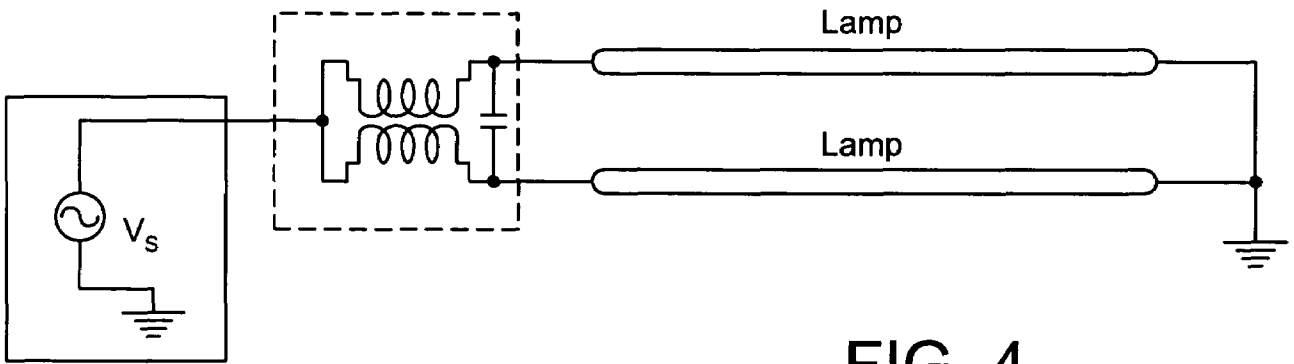
FIG. 4 (prior art)
FIG. 4 is a prior art current balancing circuit having one transformer and one capacitor connected to two out ends of the transformer.
Figure 5:
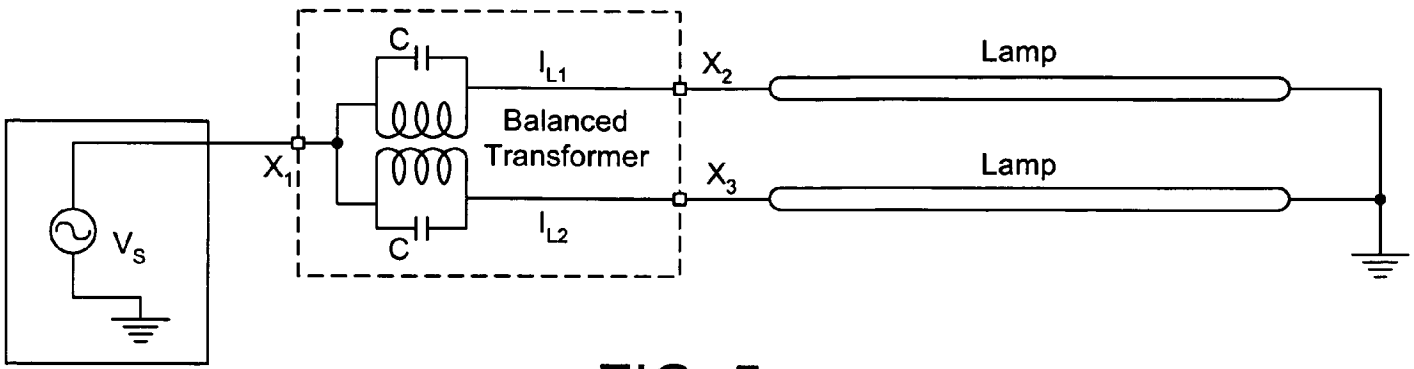
FIG. 5 is a basic circuit block of the current balancing circuit, according to present invention.
Figure 6B:
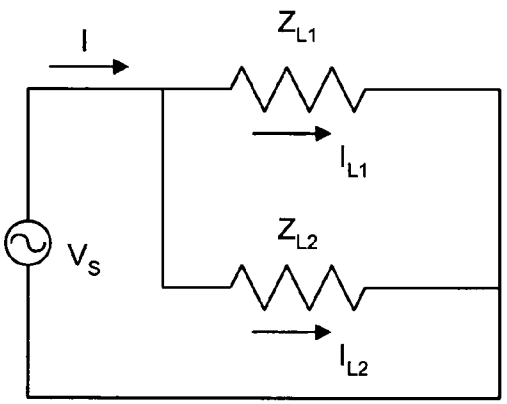
FIG. 6*b* is an equivalent circuit of the basic circuit block under the assumption that the transformer is an ideal transformer.
Figure 6A:
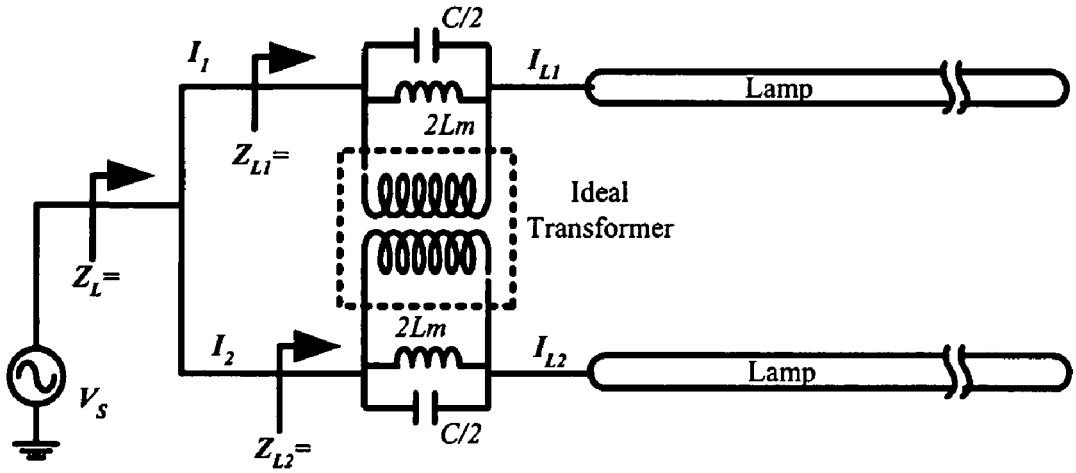
FIG. 6*a* is an equivalent circuit of the basic circuit block, according to the present invention.

FIG. 5 shows a basic circuit block of the current balancing circuit, according to the present invention. The basic circuit block can be viewed as the basic type current balancing circuit or a one-level current balancing circuit. The circuit makes use of the magnetic coupling between the two coils in the transformer to equalize the current $I_{L1}$ in the first current path and the current $I_{L2}$ in the second current path. Two capacitors C are connected in parallel in the transformer such that each capacitor is connected between the two ends of each coil. The principle of current balancing can be explained by using the equivalent circuit as shown in FIGS. 6*a* and 6*b*.

Let the parallel capacitive impedance and the inductive impedance be:

$$Z_C = \frac{1}{j\omega C},\ Z_L = j\omega L$$

and their overall parallel impedance be $$Z_{th} = Z_{L1} = Z_{L2}$$

$$Z_{th} = Z_C // Z_L = \frac{Z_C \cdot Z_L}{Z_C + Z_L} = \frac{(L/C)}{(1/j\omega C) + (j\omega L)}$$

In an ideal transformer, the impedance loss=0, or $|Z_{th}| \rightarrow \infty$. We have $$(1/j\omega C) + (j\omega L) = 0$$

$$\Rightarrow \omega^2 LC = 1$$

$$\Rightarrow \omega = \frac{1}{\sqrt{LC}}$$

According to FIG. 6*b*, we have $$I_{L1} = I \times Z_{L2}/(Z_{L1} + Z_{L2})$$

$$I_{L2} = I \times Z_{L1}/(Z_{L1} + L_{L2})$$

Because $$Z_{L1} = Z_{L2}$$

we have $$I_{L1} = I_{L2}$$

As shown in FIG. 5, the two induction coils of the transformer are electrically connected together at the input end to receive an input current from the inverter driver. The output end of each of the induction coils is connected to a separate current path. The current $I_{L1}$ in the first current path is equal to the current $I_{L2}$ of the second current path. If the input current is I, then $I_{L1} = I_{L2} = I/2$.

Figure 7:
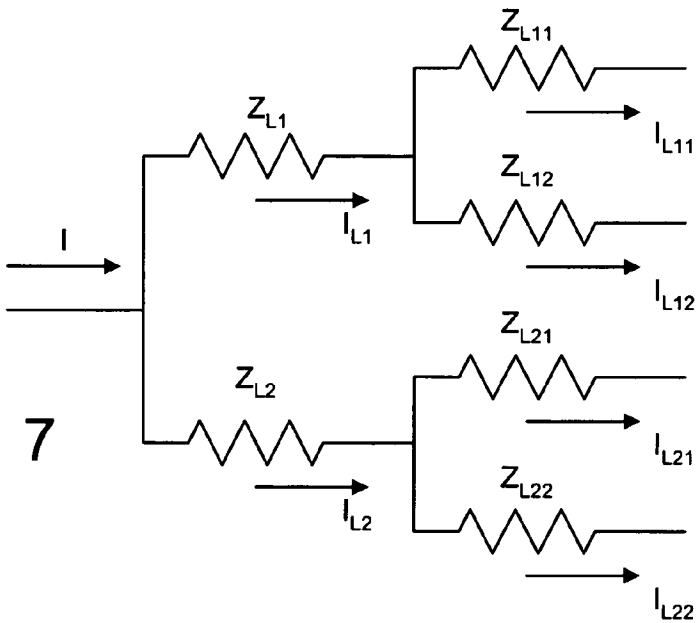
FIG. 7 is a schematic representation showing the principle for current splitting in a current balancing circuit.

The basic type current balancing circuit for providing a current in each of the two current paths can be expanded into a multi-level current balancing circuit. As illustrated in FIG. 7, the current $I_{L1}$ can be split by means of another transformer into two equal currents $I_{L11}$ and $I_{L12}$. Likewise, the current $I_{L2}$ can be split by means of a third transformer into two equal currents $I_{L21}$ and $I_{L22}$. Accordingly, we have $$I_{L11} = I_{L12} = I_{L1}/2 = I/4$$

$$I_{L21} = I_{L22} = I_{L2}/2 = I/4$$

Figure 8:
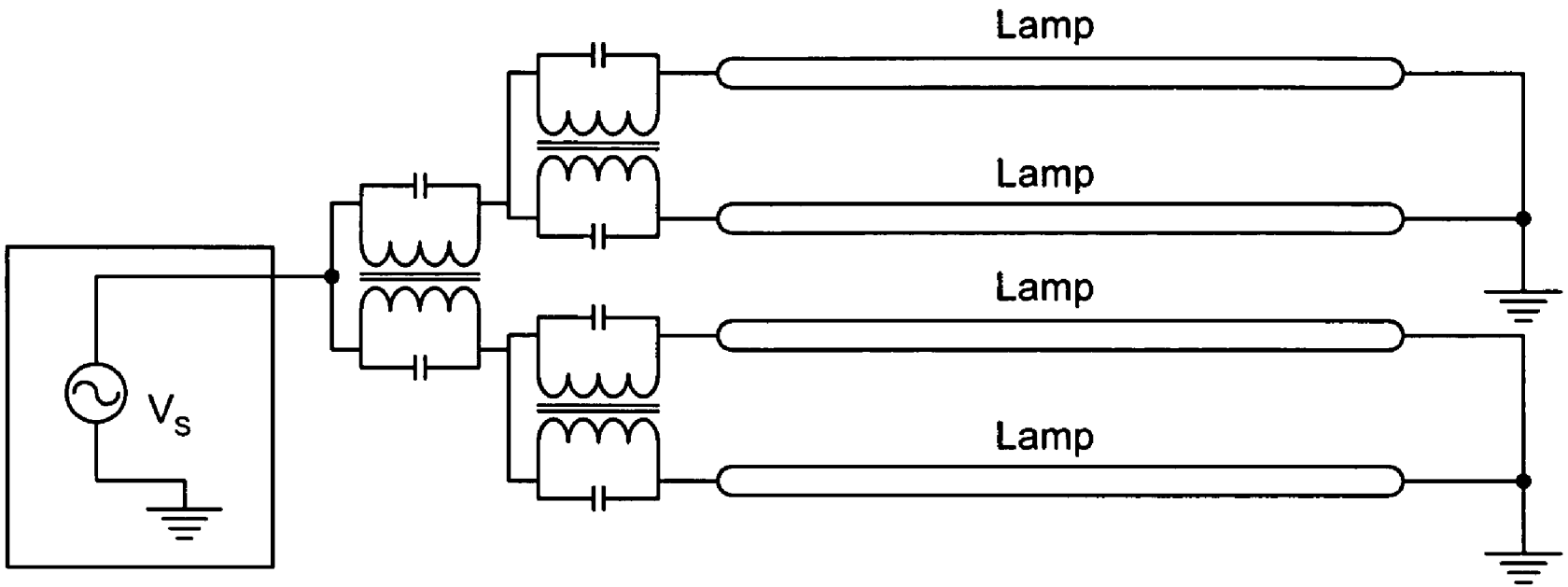
FIG. 8 is a schematic representation of a two-level current balancing circuit for driving four lamps, according to the present invention.

As such, we have a current balancing circuit with four balanced current paths to drive four lamps, as shown in FIG. 8. FIG. 8 shows a two-level type current balancing circuit, according to the present invention.

Figure 9:
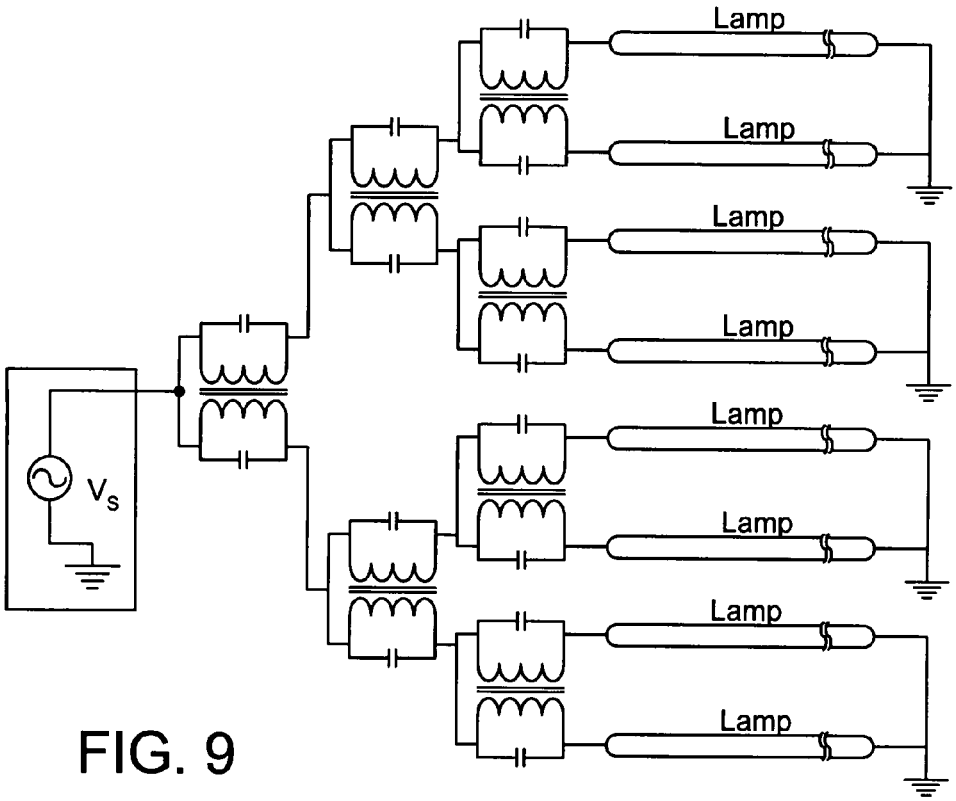
FIG. 9 is a schematic representation of a three-level current balancing circuit for driving eight lamps, according to the present invention.
Figure 10:
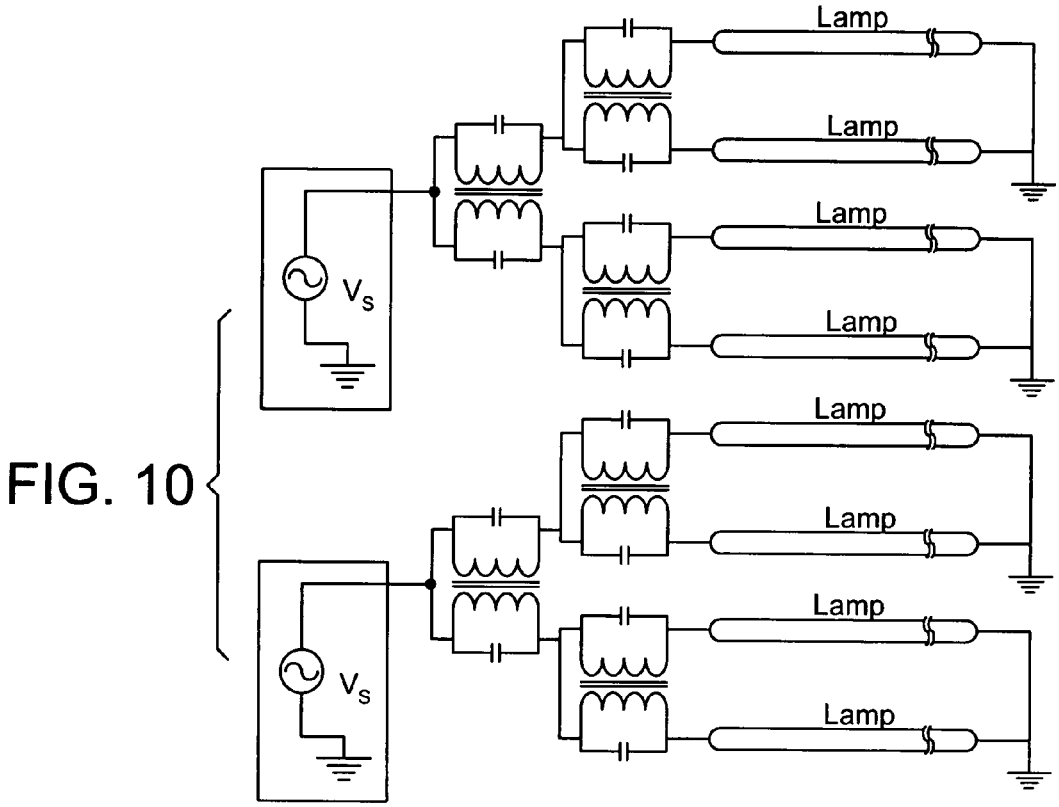
FIG. 10 is a schematic representation showing another driving circuit for driving eight lamps, according to the present invention.
Figure 11:
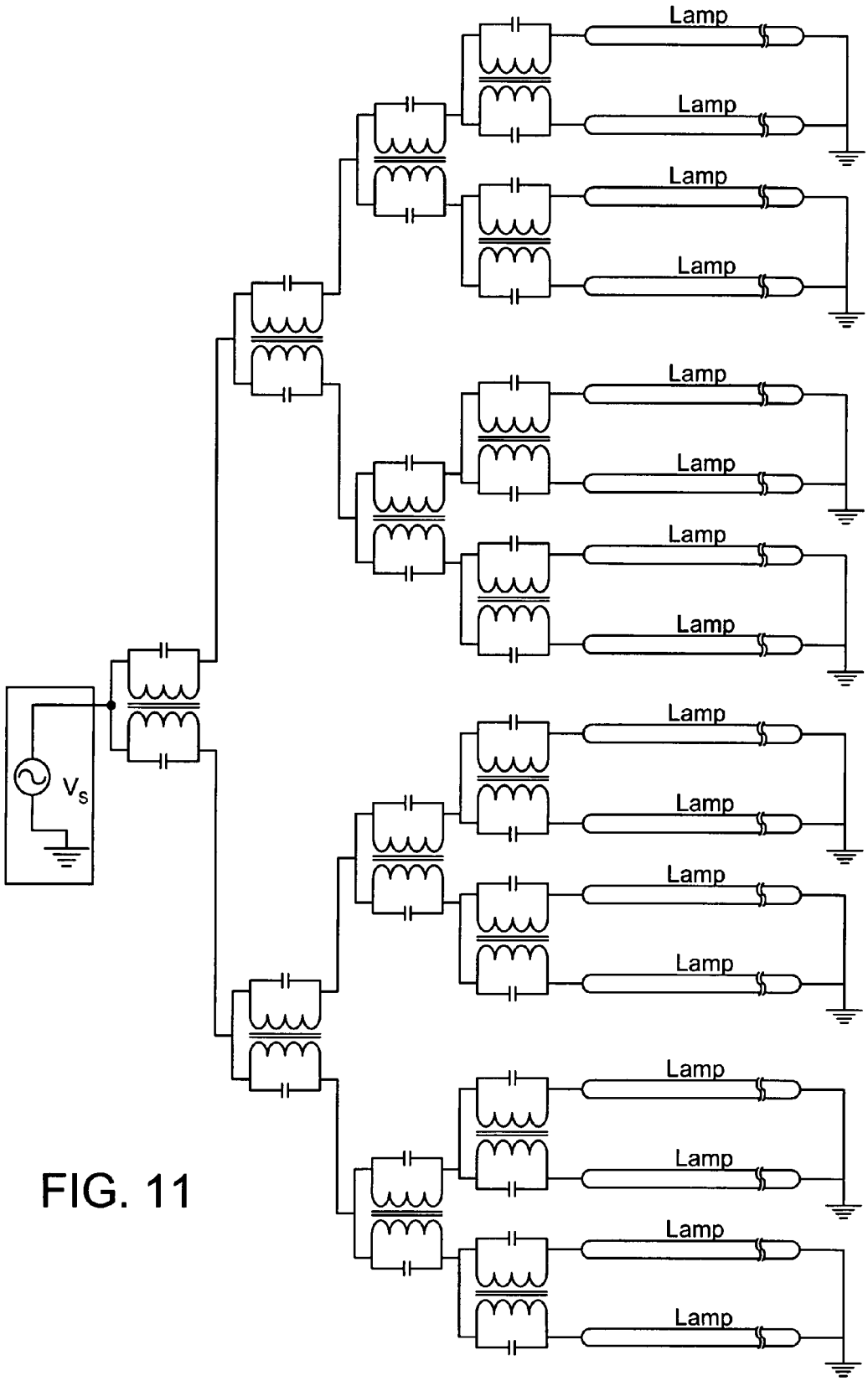
FIG. 11 is a schematic representation of a four-level current balancing circuit for driving sixteen lamps, according to the present invention.

The same principle applies to n-level type current balancing circuit, where n can be three or greater so long as the inverter driver can provide the total current in the current balancing circuit. FIG. 9 shows a three-level type current balancing circuit for driving eight lamps. FIG. 10 shows two-level type current balancing circuits for driving eight lamps. FIG. 11 shows a four-level type current balancing circuit for driving sixteen lamps.

Figure 12:
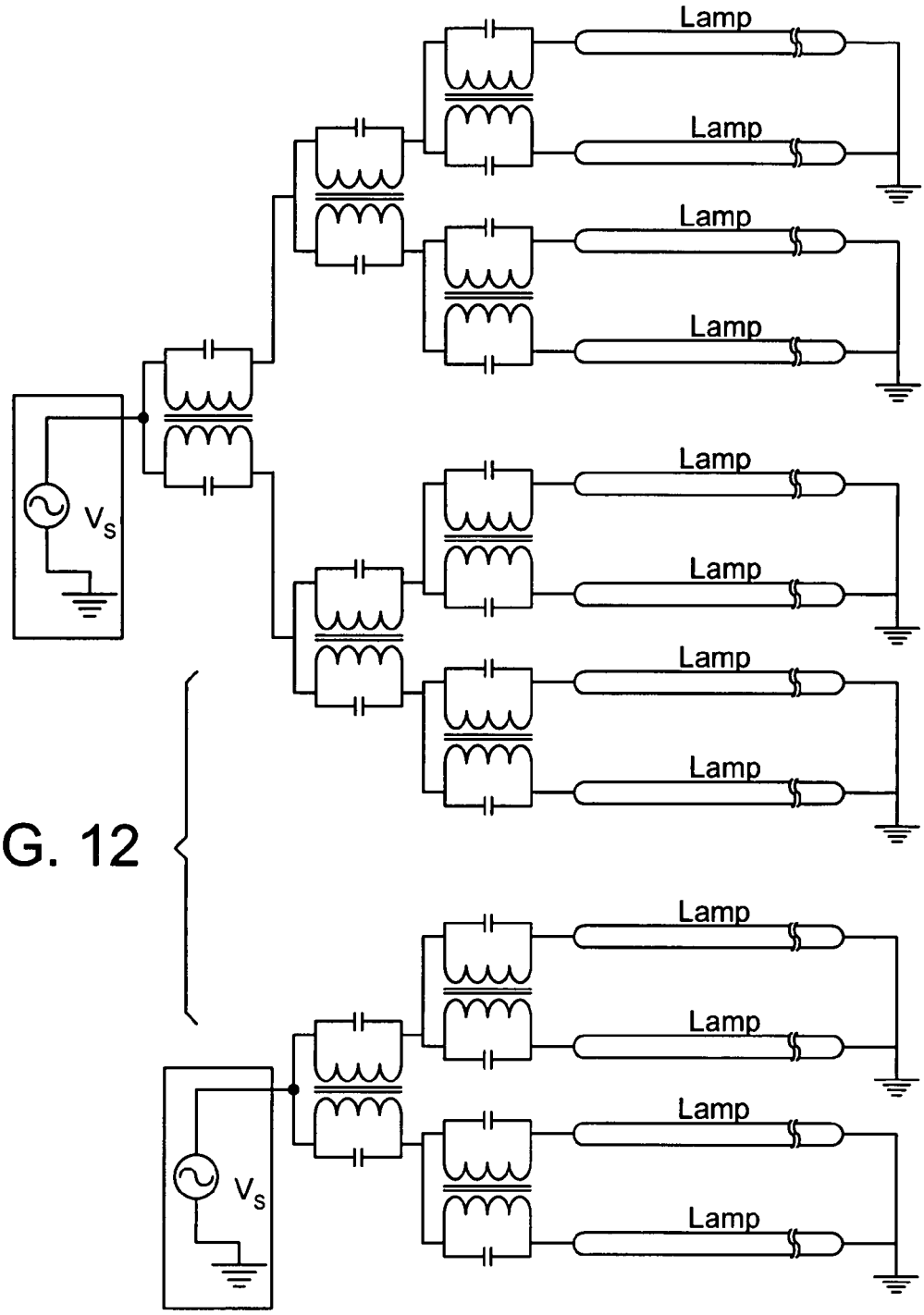
FIG. 12 is a schematic representation showing a driving circuit for driving twelve lamps, according to the present invention.

In FIGS. 5, 8, 9, 11 and 12, it has been shown that when one inverter driver is used to drive $2^m$ pairs of lamps, $2^{m+1}-1$ transformers are used to balance the currents in all current paths. It is also possible to reduce the number of transformers buy using more inverter drivers. For example, it is possible to use two inverter drivers to drive 2 m pairs of lamps with each inverter driver driving $2^{m-1}$ pairs of lamps. In that case, the required number of transformers is $2\times(2^m-1)$. When m=2, we have 4 pairs of lamps driven by two inverter drivers and we use six transformers, as shown in FIG. 10. When we have twelve lamps, it is possible to divide these lamps in a group of 8 (m=2) and a group of 4 (m=1). As shown in FIG. 12, it is possible to use two inverter drivers and ten transformers to drive twelve lamps.

In sum, the present invention provides a method for driving a light source with plurality of lamps in a balanced current manner so that the uniformity in the brightness of the light source can be improved. In prior art, when capacitors are used to reduce the imbalance in the current paths, one transformer is connected to only two lamps. As such, it is required to use N inverter drivers and N transformers to drive N pairs of lamps. The present invention is able to reduce the number of inverter drivers by using more transformers. According to the present invention, it is possible to use K inverter drivers to drive N pairs of lamps in a light source, where K<N and N>1. In particular, when $N=2^m$ with m being an integer, it is possible to use only one inverter driver.

Although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A circuit block for use in a driving circuit providing currents to a light source, the circuit block having a block input for receiving an input current, a first block output and a separate second block output for separately providing current to the light source, said circuit block comprising:

a transformer having a first coil and a second coil magnetically coupled to each other, each of the first and second coils having an input end and an output end;

a first capacitor connected between the input end and the output end of the first coil, the output end of the first coil forming the first block output; and a second capacitor connected between the input end and the output end of the second coil, the output end of the second coil forming the second block output, wherein the input end of the first coil and the input end of the second coil are coupled to each other to form the block input for receiving the input current so as to provide a first output current to the light source through the first block output and a second output current to the light source through the second block output.

2. The circuit block of claim 1, wherein the light source comprises a plurality of lamps, and wherein the first block output is connected to one of said plurality of lamps and the second block output is connected to a different one of said plurality of lamps for providing thereto the first and second output currents.

3. The circuit block of claim 1, wherein the first block output is connected to the block input of a first one of other circuit blocks and the second block output is connected to the block input of a second one of the other circuit blocks for providing thereto the first and second output currents.

4. A method for providing currents to a plurality of lighting devices, comprising:

providing a transformer having a first coil and a second coil magnetically coupled to each other, each of the first and second coils having an input end and an output end, wherein the input end of the first coil is coupled to the input end of the second coil to form a current input for receiving input current, and wherein the output end of the first coil and the output end of the second coil are separately coupled to different lighting devices for providing currents thereto;

coupling a first capacitor between the input end and the output end of the first coil; and coupling a second capacitor between the input end and the output end of the second coil.

5. The method of claim 4, wherein the lighting devices comprise a first lamp and a second lamp, and wherein the output end of the first coil is coupled to the first lamp and the output end of the second coil is coupled to the second lamp.

6. The method of claim 5, wherein the lighting devices comprise a third lamp and a fourth lamp, said method further comprising:

providing a second transformer having a third coil and a fourth coil magnetically coupled to each other, each of the third and fourth coils having an input end and an output end, wherein the input end of the third coil is coupled to the input end of the fourth coil to form a second current input for receiving input current;

coupling a third capacitor between the input end and the output end of the third coil;

coupling a fourth capacitor between the input end and the output end of the fourth coil;

coupling the output end of the third coil to the third lamp;

coupling the output end of the fourth coil to the fourth lamp;

providing a third transformer having a fifth coil and a sixth coil magnetically coupled to each other, each of the fifth and sixth coils having an input end and an output end;

coupling a fifth capacitor between the input end and the output end of the fifth coil;

coupling a sixth capacitor between the input end and the output end of the sixth coil;

coupling the output end of the fifth coil to the current input, coupling the output end of the sixth coil to the second current input; and coupling the input end of the fifth coil to the input end of the sixth coil to form a third current input for receiving current for providing input current to the input end of the fifth coil and the input end of the sixth coil.

7. The method of claim 4, wherein the lighting devices comprise a first, a second, a third, and a fourth lamps, said method further comprising:

providing a second transformer having a third coil and a fourth coil magnetically coupled to each other, each of the third and fourth coils having an input end and an output end, wherein the input end of the third coil is coupled to the input end of the fourth coil to form a second current input for receiving a portion of the input current;

coupling a third capacitor between the input end and the output end of the third coil;

coupling a fourth capacitor between the input end and the output end of the fourth coil;

coupling the output end of the third coil to the first lamp;

coupling the output end of the fourth coil to the second lamp;

providing a third transformer having a fifth coil and a sixth coil magnetically coupled to each other, each of the fifth and sixth coils having an input end and an output end, wherein the input end of the fifth coil is coupled to the input end of the sixth coil to form a third current input for receiving another portion of the input current;

coupling a fifth capacitor between the input end and the output end of the fifth coil;

coupling a sixth capacitor between the input end and the output end of the sixth coil;

coupling the output end of the fifth coil to the third lamp;

coupling the output end of the sixth coil to the fourth lamp.

* * * * *

UNITED STATES PATENT AND TRADEMARK OFFICE

CERTIFICATE OF CORRECTION

PATENT NO. : 7,443,112 B2
APPLICATION NO. : 11/890055
DATED : October 28, 2008
INVENTOR(S) : Wey et al.

It is certified that error appears in the above-identified patent and that said Letters Patent is hereby corrected as shown below:

In column 3, line 34, "$L_{L2}$" should be --$Z_{L2}$--.

Signed and Sealed this

Sixth Day of January, 2009

JON W. DUDAS
*Director of the United States Patent and Trademark Office*